US005628872A

United States Patent [19]

Backlund et al.

[11] Patent Number: 5,628,872

[45] Date of Patent: May 13, 1997

[54] METHOD FOR BLEACHING PULP WITH HYDROGEN PEROXIDE RECOVERED FROM CELLULOSIC SPENT LIQUOR

[75] Inventors: Ake Backlund, Karlstad; Lars Stigsson, Hammaro; Ove Wallergard, Hjalteby, all of Sweden

[73] Assignee: Kanyr AB, Karlstad, Sweden

[21] Appl. No.: 419,770

[22] Filed: Apr. 10, 1995

Related U.S. Application Data

[63] Continuation of Ser. No. 139,706, Oct. 22, 1993, abandoned.

[51] Int. Cl.[6] ..... D21C 11/06; D21C 11/12

[52] U.S. Cl. ..... 162/16; 162/29; 162/78; 423/588; 423/DIG. 3

[58] Field of Search ..... 162/14, 16, 29, 162/30.11, 31, 51, 78; 423/655, 656, DIG. 3, 245.1, 564, 588

[56] References Cited

U.S. PATENT DOCUMENTS

| | | | |
|---|---|---|---|
| 3,762,989 | 10/1973 | Timpe | 162/16 |
| 4,552,748 | 11/1985 | Berglin et al. | 423/558 |
| 4,553,981 | 11/1985 | Fuderer | 48/62 R |
| 4,601,786 | 7/1986 | Santen et al. | 162/30.1 |
| 4,808,264 | 2/1989 | Kignell | 162/30.1 |
| 5,374,333 | 12/1994 | Nykanen et al. | 162/31 |

FOREIGN PATENT DOCUMENTS

| | | |
|---|---|---|
| 989558 | 5/1976 | Canada . |
| 1214313 | 11/1986 | Canada . |
| 2041536 | 11/1991 | Canada . |
| 2043605 | 1/1991 | Canada . |
| 0102934 | 3/1984 | European Pat. Off. . |
| 0120934 | 3/1984 | European Pat. Off. . |
| 0459963 | 12/1991 | European Pat. Off. . |
| 2938486 | 12/1993 | Sweden . |
| 9410085 | 5/1994 | WIPO . |

OTHER PUBLICATIONS

Decision of the European Board of Appeals, Case No. T 0558/92, Sep. 1993.

Decision of the European Board of Appeals, Case No. T 0407/91, Mar. 1993.

Decision of the European Board of Appeals, Case No. T 0216/85, Jun. 1987.

Decision of the European Board of Appeals, Case No. T 0315/88, Oct. 1989.

Decision of the European Technical Board of Appeals, Case No. T 130/89, Feb. 1990.

Decision of the European Technical Board of Appeal, Case No. T21/81, Sep. 1982.

Decision of the European Technical Board of Appeals, Case No. T 4267/88, Nov. 1990.

Decision of the European Technical Board of Appeals, Case No. T 206/83, Mar. 1986.

Decision of the European Technical Board of Appeals, Case No. T 60/89, Aug. 1990.

Decision of the European Board of Appeals, Case No. T 0214/818, Jun. 1993.

Heydom et al., CEH Product Review, Hyddrogen Peroxide, The Chemical Economics Handbook—SRI International, Jun. 1992, 741,5001 R–741,5001 V.

Liu et al, Hydrogen Production From Black Liquor Wastes, ACS Div, Fuel Chem., Prepr. 21(1976): 1, 53–60.

Liu et al., Pyrolytic Gasification of Kraft Black Liquors, Periodical Unknown, Date Unknown, pp. 161–169.

Ullmann's Encyclopedia of Industrial Chemistry, Fifth, Completely Revised Edition, vol. A13; High–Performance Fibers to Imidazole and Derivatives, pp. 316–385, 443–447.

Rapson et al. "The Effluent–Free Bleached Kraft Pulp Mill"—vo. 156, No. 9, Sep. 1973, TAPPI, pp. 112–115.

*Primary Examiner*—Donald E. Czaja
*Assistant Examiner*—Dean T. Nguyen
*Attorney, Agent, or Firm*—Cushman, Darby & Cushman IP Group of Pillsbury, Madison & Sutro LLP

[57] ABSTRACT

The process for producing hydrogen peroxide, used in the bleaching of pulp, uses the hydrogen generated wholly or partly by the gasification or partial combustion of cellulose spent liquors used in digesting cellulose material to produce the hydrogen peroxide.

22 Claims, No Drawings

METHOD FOR BLEACHING PULP WITH HYDROGEN PEROXIDE RECOVERED FROM CELLULOSIC SPENT LIQUOR

This is a continuation of application Ser. No. 08/139,706, filed on Oct. 22, 1993, now abandoned.

FIELD OF THE INVENTION

The present invention relates to a process for the production of hydrogen peroxide from cellulose spent liquors by means of the partial oxidation of the cellulose spent liquor, in which a gaseous product containing hydrogen gas is produced. The gaseous product is purified and concentrated with respect to the hydrogen, which purified hydrogen is wholly or partly used as a raw material for producing hydrogen peroxide.

BACKGROUND OF THE INVENTION

In order to satisfy present-day and future environmental demands in relation to the production of chemical pulp, novel methods have been developed or are under development for the final delignification and bleaching of pulp.

For several decades, chlorine and chlorine compounds have been utilized in the bleaching of cellulose, but an ever increasing environmental awareness and a trend towards closing the pulp production process to an ever increasing extent, thereby rendering more difficult the return of residual products from the bleaching to the recovery system, has had the result that bleaching chemicals which do not contain chlorine are now being used to an ever greater extent. In recent years, an evermore widespread use of an alkaline oxygen bleaching stage following the delignification in the digester vessel has markedly decreased the need for bleaching chemicals for the final bleaching. In spite of this, the bleaching chemicals are still responsible for a considerable part of the costs of producing bleached pulp.

An alternative to chlorine-containing bleaching chemicals is to use different forms of peroxide compounds, such as, for example, hydrogen peroxide, which have been used in industrial bleaching since the beginning of this century. However, bleaching pulp solely with peroxides is usually insufficient to meet the demands placed by the market on brightness, inter alia. The use of peroxides in combination with other chlorine-free bleaching chemicals, such as, for example, ozone, is rapidly gaining ground and provides a good pulp quality with regard to both brightness and strength. The use of peroxides, including both inorganic peroxides, such as hydrogen peroxide and sodium peroxide, and organic peroxides, such as peracetic acid, has been tested out with favorable results in connection with bleaching pulp. However, hydrogen peroxide is the compound which is most frequently employed and it has several advantages from the environmental point of view as well as good commercial availability.

However, the cost of the hydrogen peroxide, which is responsible for the major part of the total cost of bleaching to a given brightness, represents an important disadvantage. As a consequence, peroxides, despite their advantages, have hitherto only been utilized to a small extent for bleaching pulp and then usually in the final stages of the bleaching process.

The main object of the present invention is to improve the prerequisites for using the environmentally advantageous hydrogen peroxide in connection with bleaching paper pulp. It has been found that, with the aid of the invention, it is possible, in a very advantageous and somewhat surprising manner, to produce peroxides within the pupling digester works starting from readily available raw material, mainly by the gasification or partial combustion of cellulose spent liquors in order to generate the hydrogen gas which is necessary for manufacturing the hydrogen peroxide.

The method which is nowadays by far the most prevalent for producing hydrogen peroxide is the so-called AO process, or anthraquinone process. In the AO process, an alkylanthraquinone is hydrogenated in the presence of a catalyst to give the corresponding hydroquinone, which in turn is oxidized by oxygen or air with the formation of hydrogen peroxide. The hydrogen peroxide is extracted with water and the quinone which is reformed is returned to the hydrogenation stage, thereby completing the loop. The process has been carried out commercially for several years and is now well established. Solutions of hydrogen peroxide in water are commercially available in concentrations up to 90 per cent by weight, but 35–70% strength solutions are most common in connection with bleaching. The starting materials for hydrogen peroxide production are hydrogen and oxygen, or air. Oxygen is presently used to an ever increasing extent within the cellulose industry, particularly for delignifying pulp, and is therefore available at most factories. Hydrogen is not normally present and is not currently used within the cellulose industry. Industrial production of hydrogen mainly occurs within the petrochemical industry and the alkali metal chloride industry, the main areas of use for hydrogen being the manufacture of ammonia and methanol.

The hydrogen is normally produced by the gasification of different hydrocarbons, such as, for example, tar, liquid petroleum gas or hard coal. A disadvantage of producing hydrogen gas from these raw materials is that the carbon dioxide ($CO_2$) which is produced at the same time does not originate from a biomass fuel. Emission of carbon dioxide originating from the gasification or combustion of non-biomass fuels is considered to constitute a less desirable contribution in the atmosphere and is therefore subject to a tax or charge in many countries. In principle, all raw materials containing hydrogen can be used for producing hydrogen gas by gasification, and since 1988 a gasification plant in Finland has been in operation for producing hydrogen gas from peat.

In principle, all gasification processes can be utilized for producing hydrogen gas. The highest yield is obtained by gasifying with oxygen at high temperature, resulting in a synthesis gas containing in the main hydrogen and carbon monoxide. The carbon monoxide can be reacted (shifted) with water, with the formation of hydrogen and carbon dioxide, in accordance with the water gas reaction. The reaction is carried out in one or more shift reactors coupled in series. In the delignification of wood according to the sulphate cellulose method, a water-containing residual product is obtained which also contains an organic fraction consisting in the main of lignin compounds, oxidized carbohydrates and organic extracted matter, and an inorganic fraction containing alkali metal salts. Normally, the residual product or the black liquor, which is therefore a biomass fuel, is burnt to recover energy and chemicals according to well-known and established technology.

However, it has emerged that partial combustion or gasification of the black liquor can provide important advantages. A technique for partial combustion or gasification which is particularly suitable when applying the present invention is the so-called CHEMREC technique, which, inter alia, is described in U.S. Pat. Nos. 4,601,786, 4,808,264 and SE-466 268.

However, other gasification techniques, such as, for example, gasification in a fluid bed, can also be used when applying the present invention.

Gasification of black liquor is already practiced today on a commercial scale and is expected to increase in importance. Other spent liquors and lignin-containing materials occurring within the cellulose industry, for example bleaching plant effluent concentrates, can also be gasified in suitable equipment for recovering both energy and chemicals, or alternatively used for producing hydrogen gas in accordance with the present invention.

SUMMARY OF THE INVENTION

It has emerged that the gas which evolves when gasifying these raw materials can, in an economically attractive manner, be purified and concentrated with regard to its content of hydrogen. Purified and concentrated hydrogen, obtained in this way, is highly suitable as a starting material for producing hydrogen peroxide, resulting in the achievement of the main object of the present invention, namely that of creating an opportunity for producing hydrogen peroxide within the factory.

In a particularly preferred embodiment of the invention, black liquor is gasified in a reactor with the simultaneous addition of oxygen-containing gas, consisting mainly of pure oxygen, resulting in the black liquor being partially oxidized. The oxygen containing gas is supplied in a quantity corresponding to 20–70% of the oxygen requirement which is necessary for completely oxidizing the black liquor. The partial oxidation or gasification is effected at a temperature of about 850° C. and under a pressure of about 1–25 bar, preferably 3–10 bar. The hot hydrogen-containing process gas which arises under these conditions is cooled by direct contact with a cooling liquid, in which liquid inorganic sodium compounds are dissolved and are separated off for preparing cooking chemicals. The cooled gas is heat-exchanged and reacted with aqueous steam in three shift reactors coupled in series, in which carbon monoxide and water react to form hydrogen and carbon dioxide.

The shifted gas is subsequently washed with an amine solution (for example MEA, monoethanolamine), resulting in the content of carbon dioxide and hydrogen sulfide in the gas being decreased to less than 0.1%. The synthesis gas, which is purified in this way and which in the main contains hydrogen, is transferred to a plant for producing hydrogen peroxide. According to another embodiment, the gaseous product is enriched with regard to hydrogen by means of an adsorption process, preferably a PSA process (pressure swing adsorption). The PSA plant operates in the main at constant temperature and the gas separation is based on partial pressure differences of the different gases, with the components which are to be separated being adsorbed at high operating pressures and high partial pressure, and being desorbed at a low operating pressure in accordance with the appropriate adsorption isotherm.

The hydrogen peroxide is suitably produced in a plant based on the anthraquinone process, in which process anthraquinone derivatives dissolved in a working solution are subjected to alternating hydrogenation and oxidation.

The hydrogen peroxide product obtained in this way is transferred and used for bleaching paper pulp.

Besides the above mentioned advantages, the production of hydrogen peroxide in this manner is based on the use of a biomass fuel as raw material. In addition to this, it should be pointed out that the production of hydrogen peroxide within the factory is also energetically advantageous in view of the fact that most factories have an energy surplus from the combustion, gasification of cellulose spent liquors.

Several types of cellulose and lignin containing raw materials can be used for producing hydrogen according to the present invention. Particularly preferred raw materials include spent liquors from sulphate, sulphite and soda processes. For the gasification, the dry matter content of the liquors should be as high as possible, preferably over 65%, and completely dry liquors can also be used when applying the present invention.

Other suitable raw materials include different types of bleaching plant effluent containing organic substance, such as, for example, the effluent from oxygen delignification, chlorine-containing bleaching plant effluents or the effluent from a peroxide/ozone bleaching plant. For the gasification, the dry matter content of the effluents should be as high as possible, and completely dry concentrates can also be used when applying the present invention. Most bleaching plant effluent concentrates have a low energy value and it can, therefore, in certain cases, be appropriate to supply a supporting fuel, for example natural gas, during the gasification.

DETAILED DESCRIPTION OF THE INVENTION

The invention will be better understood with reference to the following examples of using a process according to the invention given below.

EXAMPLE 1

A component stream of a black liquor flow in a sulphate pulp plant is drawn off to a gasifier for producing hydrogen for hydrogen peroxide production within the plant or factory.

On entry into the gasifier, the black liquor, which has been evaporated down to high dry matter content, has the following parameters:

| | |
|---|---|
| Flow 1000 kg/h (dry matter) | |
| Dry matter content | 70% |
| Temperature | 140° C. |
| Calorific value | 14.4 MJ/kg of dry matter |

Pure oxygen (99%) at a temperature of 100° C. is supplied, together with the liquor, to the reaction zone of the gasifier where a temperature of 900° C. is maintained by the partial oxidation of the liquor. The oxygen flow is 300 Nm3/h. The pressure in the gasification reactor is about 6 bar.

A synthesis gas is produced essentially having the following composition:

| | |
|---|---|
| CO | 29.6% dry gas |
| $H_2$ | 41.7% dry gas |
| $CH_4$ | 0.1~ dry gas |
| $H_2S$ | 0.8% dry gas |
| $CO_2$ | remainder |

The gas is cooled and washed by direct contact with a water-containing cooling liquid, during which most of the content of sulphur and sodium compounds in the gas is removed.

The gas is heat-exchanged and shifted in three adiabatic shift reactors coupled in series in which steam is added and about 95% of the carbon monoxide content of the gas is converted to hydrogen according to the reaction $$CO+H_2S \rightarrow H_2+CO_2$$

The reaction is effected over a catalyst containing cobalt, molybdenum and nickel at a temperature of 250° C. After the shift reaction, the gas is washed once again in an amine wash to remove carbon dioxide. The total content of hydrogen in the crude hydrogen gas obtained is then over 90%, and corresponds to a flow of about 32 kmol $H_2$ per hour. Alternatively, the crude process gas can be supplied to a PSA plant (pressure swing adsorption) and concentrated to a purity exceeding 99%.

The pure hydrogen gas is transferred to an AO plant for producing hydrogen peroxide. The hydrogen peroxide which is obtained (975 kg/h, calculated as a 100% solution) is transferred to the bleaching plant of the sulphate pulp works.

EXAMPLE 2

A sulphate pulp works is equipped with a plant for gasifying black liquor, which gasifier has been installed in order to decrease the load on the plant's recovery boiler. The capacity of the gasification plant is about 10 tons of dry matter per hour, giving rise to a process gas production of about 28,000 Nm3/hour. A component stream (5600 Nm3/hour) of the process gas is drawn off from the main process gas stream for the production of hydrogen for producing hydrogen peroxide within the factory.

| | |
|---|---|
| CO | 12% dry gas |
| $H_2$ | 14% dry gas |
| $CO_2$ | 15% dry gas |
| $CH_4$ | 1% dry gas |
| $H_2S$ | 0.5% dry gas |
| $N_2$ | remainder |

The gas is purified and heat-exchanged and subsequently shifted in three shift reactors coupled in series, in which about 95% of the carbon monoxide content of the gas is converted to hydrogen. The crude hydrogen gas thereby obtained (50 kmol/h) is supplied to a PSA plant for purification. The pure hydrogen gas is transferred to an AO plant for producing about 1.5 tons of hydrogen peroxide/hour.

The invention is not limited by the above mentioned examples, but can be varied within the scope of the subsequent patent claims. Thus, it will be apparent to the person skilled in the art that a relatively small part of the hydrogen gas could be collected from a source other than that which is described and preferred, for example from a buffer tank which is replenished with externally produced hydrogen gas. From the point of view of overall economy, however, it is more favorable to have a storage buffer of hydrogen peroxide.

We claim:

1. A method of bleaching pulp comprising the steps of:

bleaching pulp with hydrogen peroxide;

partially combusting a spent liquor comprising lignin compounds to form a combustion gas comprising hydrogen gas;

purifying and concentrating the combustion gas to increase hydrogen gas purity and concentration;

reacting the hydrogen gas with an alkylanthraquinone in the presence of a catalyst to form hydroquinone which is oxidized with oxygen to thereby form hydrogen peroxide; and using at least a portion of the formed hydrogen peroxide in the hydrogen peroxide bleaching step.

2. The method according to claim 1, wherein the spent liquor is supplied to a reactor to which an oxygen-containing gas is being supplied simultaneously, and wherein the spent liquor is partially oxidized to form the hydrogen gas.

3. The method according to claim 2, wherein the oxygen-containing gas is supplied in an amount corresponding to 20–70% of the stoichiometric requirement for complete oxidation of the spent liquor.

4. The method according to claim 3, wherein the oxygen-containing gas is oxygen or oxygen-enriched air.

5. The method according to claim 3, wherein a temperature exceeding 500° C. is maintained in the reactor.

6. The method according to claim 3, wherein a pressure exceeding atmospheric pressure is maintained in the reactor.

7. The method according to claim 1, wherein the combustion gas is cooled by direct contact with a water containing cooling liquid.

8. The method according to claim 7, wherein the combustion gas is washed and purified with regard to its content of gaseous hydrogen sulfide by direct contact with an absorption liquid.

9. The method according to claim 1, wherein the combustion gas is purified and enriched with regard to hydrogen by an absorption process.

10. The method according to claim 1, wherein the combustion gas is enriched with regard to hydrogen by washing with an amine solution.

11. The method according to claim 1, wherein substantially all of the produced hydrogen peroxide is used in the bleaching step.

12. A method of bleaching pulp comprising the steps of:

bleaching pulp with hydrogen peroxide;

partially combusting a spent liquor comprising lignin compounds to form a combustion gas comprising hydrogen gas and carbon monoxide;

shifting the carbon monoxide to form hydrogen gas by reaction with water;

purifying and concentrating the combustion gas to increase hydrogen gas purity and concentration;

reacting the hydrogen gas with an alkylanthraquinone in the presence of a catalyst to form hydroquinone which is oxidized with oxygen to thereby form hydrogen peroxide; and using at least a portion of the formed hydrogen peroxide in the hydrogen peroxide bleaching step.

13. The method according to claim 12, wherein the spent liquor is supplied to a reactor to which an oxygen-containing gas is being supplied simultaneously, and wherein the spent liquor is partially oxidized to form the hydrogen gas.

14. The method according to claim 13, wherein the oxygen-containing gas is supplied in an amount corresponding to 20–70% of the stoichiometric requirement for complete oxidation of the spent liquor.

15. The method according to claim 14, wherein the oxygen-containing gas is oxygen or oxygen-enriched air.

16. The method according to claim 14, wherein a temperature exceeding 500° C. is maintained in the reactor.

17. The method according to claim 14, wherein a pressure exceeding atmospheric pressure is maintained in the reactor.

18. The method according to claim 12, wherein the combustion gas is cooled by direct contact with a water containing cooling liquid.

19. The method according to claim 12, wherein the combustion gas is washed and purified with regard to its content of gaseous hydrogen sulfide by direct contact with an absorption liquid.

20. The method according to claim 12, wherein the combustion gas is purified and enriched with regard to hydrogen by an absorption process.

21. The method according to claim 12, wherein the combustion gas is enriched with regard to hydrogen by washing with an amine solution.

22. The method according to claim 12, wherein substantially all of the produced hydrogen peroxide is used in the bleaching step.

* * * * *